US011295678B2

(12) United States Patent
Zheng et al.

(10) Patent No.: US 11,295,678 B2
(45) Date of Patent: Apr. 5, 2022

(54) PICTURE COMPENSATION METHOD AND DISPLAY DEVICE

(71) Applicant: KunShan Go-Visionox Opto-Electronics Co., Ltd., Jiangsu (CN)

(72) Inventors: Tianchun Zheng, Jiangsu (CN); Yi Zheng, Jiangsu (CN)

(73) Assignee: KunShan Go-Visionox Opto-Electronics Co., Ltd, Jiangsu (CN)

( * ) Notice: Subject to any disclaimer, the term of this patent is extended or adjusted under 35 U.S.C. 154(b) by 0 days.

(21) Appl. No.: 17/330,872

(22) Filed: May 26, 2021

(65) Prior Publication Data

US 2021/0280137 A1 Sep. 9, 2021

Related U.S. Application Data

(63) Continuation of application No. PCT/CN2019/116376, filed on Nov. 7, 2019.

(30) Foreign Application Priority Data

May 31, 2019 (CN) ..... 201910472981.2

(51) Int. Cl.
*G09G 3/3266* (2016.01)
*G09G 3/3225* (2016.01)
(Continued)

(52) U.S. Cl.
CPC ..... *G09G 3/3266* (2013.01); *G09G 3/3225* (2013.01); *G09G 3/3291* (2013.01);
(Continued)

(58) Field of Classification Search
CPC ..... G09G 2320/02
See application file for complete search history.

(56) References Cited

U.S. PATENT DOCUMENTS

2004/0239587 A1* 12/2004 Murata ..... G09G 3/20 345/58
2008/0074366 A1* 3/2008 Drader ..... G09G 3/3611 345/87
(Continued)

FOREIGN PATENT DOCUMENTS

CN 1637799 A 7/2005
CN 1835057 A 9/2006
(Continued)

OTHER PUBLICATIONS

PCT International Search Report for International Application No. PCT/CN2019/116376 dated Mar. 2, 2020.
(Continued)

*Primary Examiner* — Sepehr Azari

(57) ABSTRACT

Disclosed in the present disclosure are a picture compensation method and a display apparatus, the picture compensation method, including: obtaining a ratio of non-luminous pixels in an Nth scanning line to all pixels in the Nth scanning line; for each non-luminous pixel in the Nth scanning line, receiving or presetting a first data voltage; obtaining a second data voltage received or preset by a pixel in at least one of an N−1th scanning line and an N+1th scanning line located in a same column with the non-luminous pixel; in response to a transition relationship between the first data voltage and the second data voltage existing, obtaining a voltage value to be compensated for luminous pixels in the Nth scanning line based on the transition relationship and the ratio; and displaying a picture after compensating the voltage value of the luminous pixels in the Nth scanning line of pixels.

17 Claims, 5 Drawing Sheets

(51) Int. Cl.
*G09G 3/3291* (2016.01)
*G09G 3/3233* (2016.01)

(52) U.S. Cl.
CPC ..... *G09G 2320/0209* (2013.01); *G09G 2320/0233* (2013.01); *G09G 2330/021* (2013.01)

(56) References Cited

U.S. PATENT DOCUMENTS

| | | | | |
|---|---|---|---|---|
| 2009/0051627 | A1* | 2/2009 | Ihata | G09G 3/3208 345/76 |
| 2011/0090202 | A1 | 4/2011 | Han | |
| 2011/0205208 | A1* | 8/2011 | Iisaka | G09G 3/3611 345/87 |
| 2012/0018225 | A1 | 7/2012 | Horst | |
| 2013/0241968 | A1* | 9/2013 | Wakabayashi | G09G 3/3648 345/87 |
| 2013/0257917 | A1* | 10/2013 | Peng | G09G 3/3688 345/690 |
| 2015/0123964 | A1 | 5/2015 | Lee et al. | |

FOREIGN PATENT DOCUMENTS

| | | | |
|---|---|---|---|
| CN | 103943093 | A | 7/2014 |
| CN | 104464621 | A | 3/2015 |
| CN | 105137689 | A | 12/2015 |
| CN | 107068062 | A | 8/2017 |
| CN | 107170419 | A | 9/2017 |
| CN | 107516504 | A | 12/2017 |
| CN | 108510940 | A | 9/2018 |
| CN | 110223642 | A | 9/2019 |
| KR | 20170132401 | A | 12/2017 |
| KR | 20180102733 | A | 9/2018 |
| TW | I545553 | B | 8/2016 |

OTHER PUBLICATIONS

PCT Written opinion for International Application No. PCT/CN2019/116376 dated Mar. 2, 2020.
Chinese First Office Action for CN Application No. 201910472981.2 dated Feb. 26, 2020.
Taiwan First Office Action for Application No. 108142620 dated Jun. 12, 2020.

* cited by examiner

PICTURE COMPENSATION METHOD AND DISPLAY DEVICE

CROSS REFERENCE

The present application is a continuation-application of International (PCT) Patent Application No. PCT/CN2019/116376, filed on, Nov. 7, 2019, which claims foreign priority of Chinese Patent Application No. 201910472981.2, filed on May 31, 2019, in the National Intellectual Property Administration of China, the entire contents of which are hereby incorporated by reference in its entirety.

TECHNICAL FIELD

The present disclosure relates to the field of display technologies, and in particular to a picture compensation method and a display device.

BACKGROUND

In a display apparatus, line crosstalk generally occurs when switching from a black screen to a white screen or a white screen to a black screen, on the extension of the boundary line between the black screen and the white screen. Generally, the longer the length of the boundary line between the black screen and the white screen, the more obvious the bright or dark lines generated by the line crosstalk. Currently, the internal structure in the display apparatus is changed to weaken the coupling capacitance between the power line and the data line, thereby achieving the purpose of reducing line crosstalk.

However, the existing method of improving the line crosstalk from the internal structure is relatively complicated and other problems may be introduced in the process.

SUMMARY OF THE DISCLOSURE

A picture compensation method is provided, including: obtaining a ratio of non-luminous pixels in an Nth scanning line to all pixels in the Nth scanning line; for each non-luminous pixel in the Nth scanning line, receiving or presetting a first data voltage; obtaining a second data voltage received or preset by a pixel in at least one of an N−1th scanning line and an N+1th scanning line located in a same column with the non-luminous pixel; in response to a transition relationship between the first data voltage and the second data voltage existing, obtaining a voltage value to be compensated for luminous pixels in the Nth scanning line based on the transition relationship and the ratio; and displaying a picture after compensating the voltage value of the luminous pixels in the Nth scanning line of pixels.

The beneficial effects of the present disclosure are that: in the scanning direction, the voltage value to be compensated is obtained based on the transition relationship that black screens cut into white screens or white screens cut into black screens, and the ratio of non-luminous pixels in the Nth scanning line to all pixels in the Nth scanning line. The picture is displayed after compensating the voltage value of the luminous pixels in the Nth scanning line. That is, in the present disclosure, the purpose of reducing line crosstalk is realized through software, which is simpler and more time-efficient compared with the existing way of changing the internal structure.

DETAILED DESCRIPTION

The technical solutions in the embodiments of the present disclosure will be clearly and completely described below in conjunction with the drawings in the embodiments of the present disclosure. Obviously, the described embodiments are only a part of the embodiments of the present disclosure, rather than all of the embodiments. Based on the embodiments in the present disclosure, all other embodiments obtained by those skilled in the art without creative work shall fall within the scope of the present disclosure.

Figure 1:
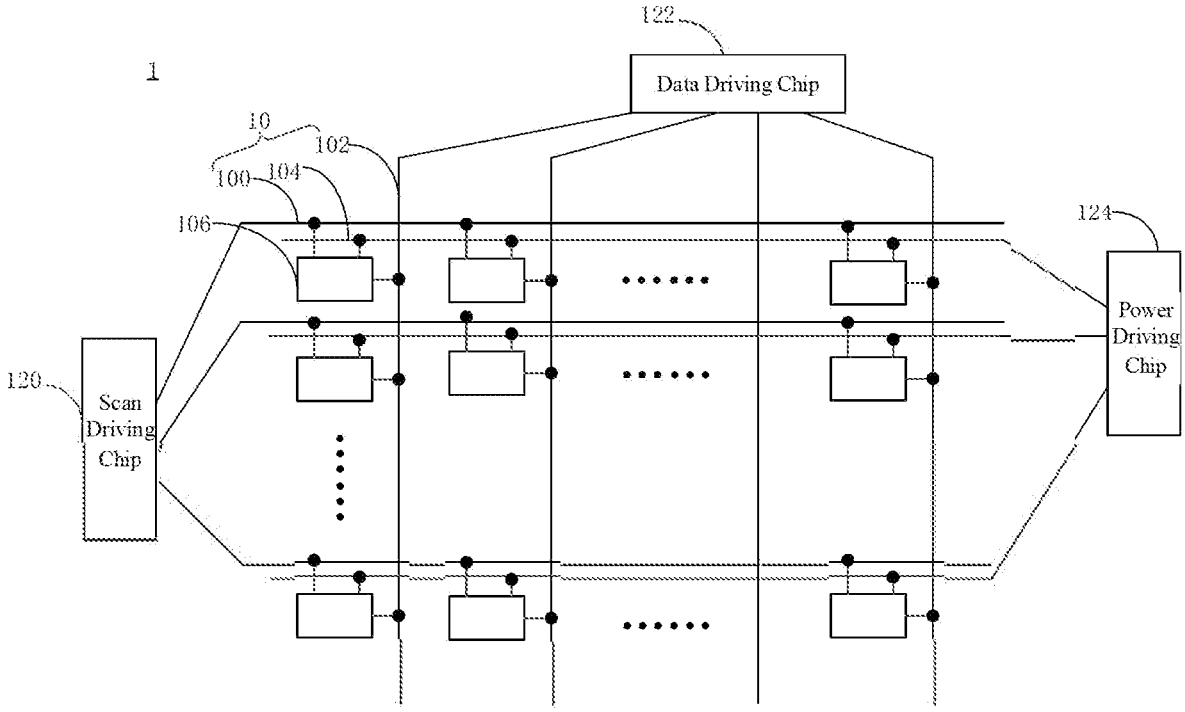
FIG. 1 is a structural schematic view of a display apparatus according to an embodiment of the present disclosure.

As shown in FIG. 1, the display apparatus 1 includes a pixel driving circuit 10 and a driving chip.

Specifically, the pixel driving circuit 10 includes a plurality of scanning lines 100 for transmitting scan signals, a plurality of data lines 102 for transmitting data signals, and a plurality of power lines 104 for transmitting voltage signals. As shown in FIG. 1, the plurality of scanning lines 100 and the plurality of data lines 102 are arranged to be vertically intersected to form a plurality of pixel units 106. Each row of the pixel units 106 is respectively connected to a corresponding scanning line 100 and a corresponding power line 104, and each column of the pixel units 106 is respectively connected to a corresponding data line 102.

The driving chip is coupled to at least one of the scanning lines 100, the data lines 102, and the power lines 104. The driving chip executes the picture compensation method before or after the picture is displayed, such that the line crosstalk phenomenon in the picture displayed after the compensation is reduced. The specific picture compensation method will be explained in the subsequent embodiments.

In the embodiment, the driving chip may include a scan driving chip 120, a data driving chip 122, and a power driving chip 124. The plurality of scanning lines 100 are connected to the scan driving chip 120. The plurality of data lines 102 are connected to the data driving chip 122. The plurality of power lines 104 are connected to the power driving chip 124. Of course, in other embodiments, at least one of the scan driving chip 120, the data driving chip 122, and the power driving chip 124 may be integrated on one driving chip.

The driving chip that executes the picture compensation method can be the data driving chip 122, the power driving chip 124, or another driving chip coupled to the data driving chip 122 or the power driving chip 124. After the other driving chip obtains the voltage value to be compensated, the voltage value is sent to the corresponding data driving chip 122 or the power driving chip 124. Then the data driving chip 122 or the power driving chip 124 compensates the corresponding voltage value.

Figure 2:
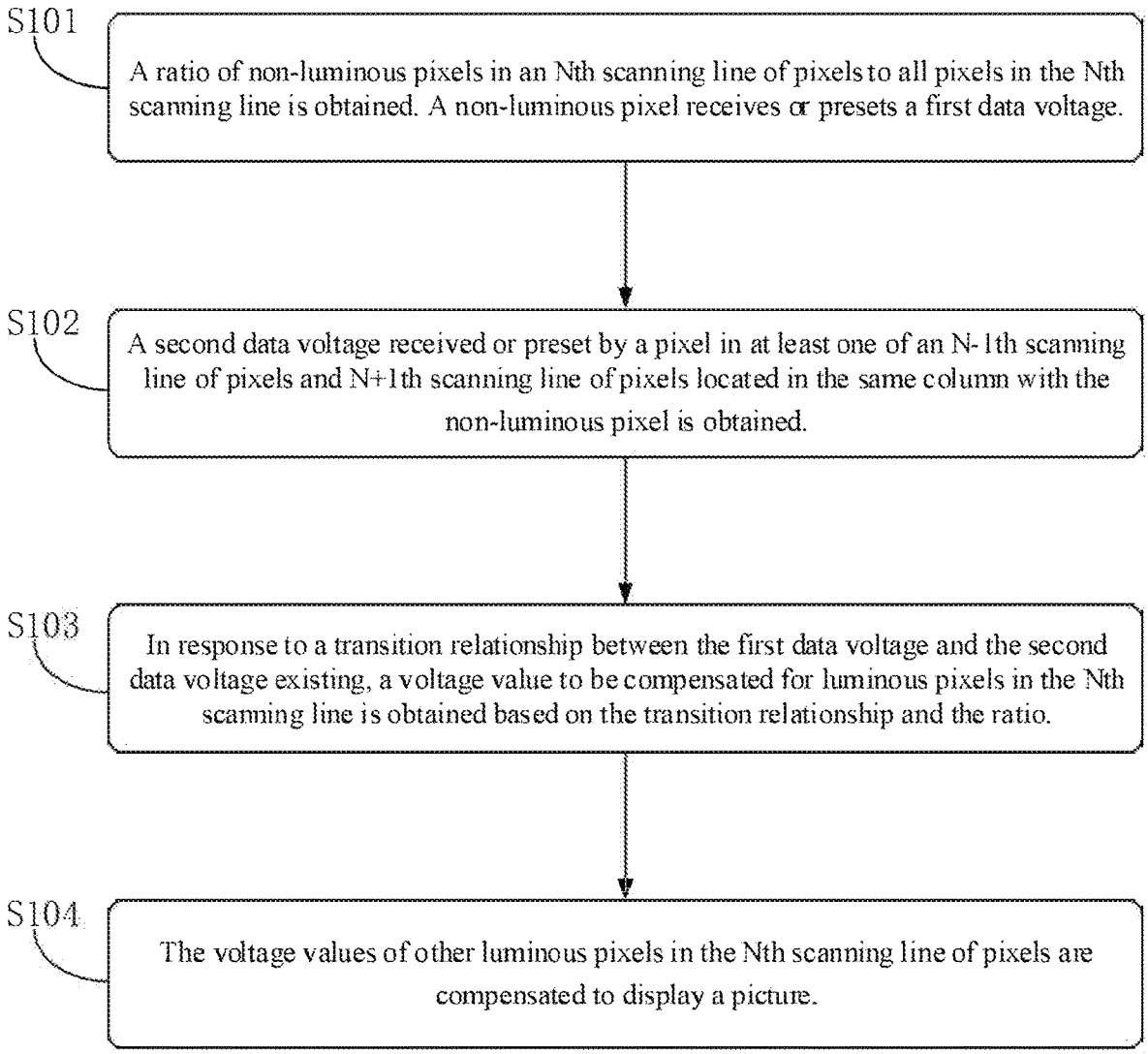
FIG. 2 is a flow chart of a picture compensation method according to an embodiment of the present disclosure.
Figure 3:
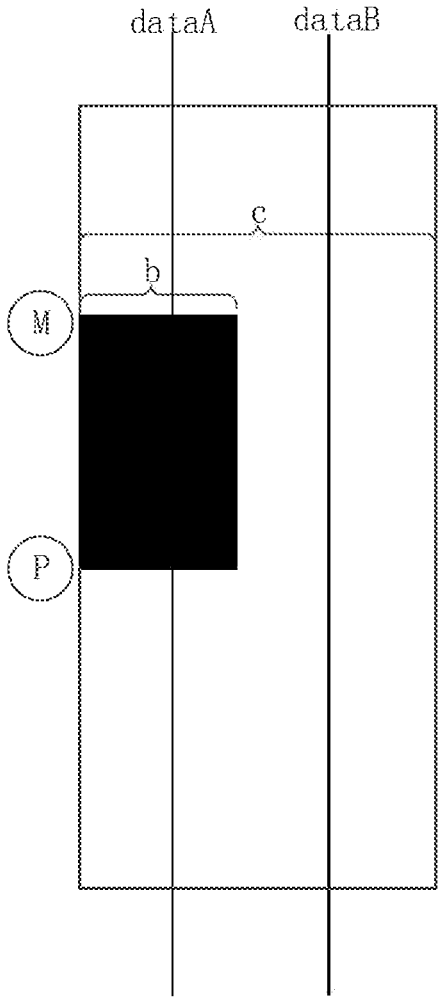
FIG. 3 is a structural schematic view of a picture to be displayed or being displayed according to an embodiment of the present disclosure.
Figure 4:
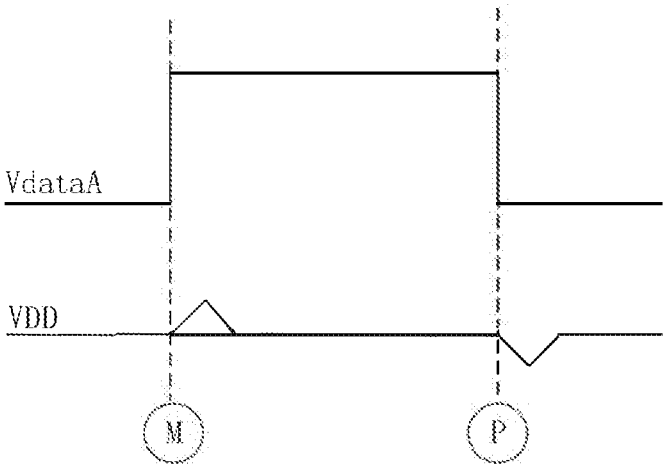
FIG. 4 is a schematic view of a sequence corresponding to the picture in FIG. 3 according to an embodiment of the present disclosure.

As shown in FIGS. 2 to 4, the compensation method includes operations at blocks illustrated in FIG. 2.

At block S101: A ratio of non-luminous pixels in an Nth scanning line of pixels to all pixels in the Nth scanning line is obtained. A non-luminous pixel receives or presets a first data voltage.

Specifically, the picture compensation method provided in the present disclosure may be applied to pictures that have already been displayed or pictures to be displayed. When the method is applied to a picture that has already been displayed, the non-luminous pixel in operation S101 receives the first data voltage. When the method is applied to the picture to be displayed, the non-luminous pixel in operation S101 is preset to receive the first data voltage.

In some embodiments, the foregoing operation S101 may be implemented as follows. The ratio may be obtained through counting the number of non-luminous pixels in the Nth scanning line and the number of all pixels in the Nth scanning line.

In some embodiments, when a pixel is driven by a driving transistor, the foregoing operation S101 may be implemented as follows. The ratio may be obtained through counting the number of driving transistors turned off in the Nth scanning line and the number of all driving transistors in the Nth scanning line.

In some embodiments, when the non-luminous pixels in the picture are continuous non-luminous pixels, as shown in FIG. 3, the foregoing operation S101 may be implemented as follows. The ratio of the length b of continuous non-luminous pixels in the Nth scanning line of pixels to the length c of the display area is obtained.

At block S102: A second data voltage received or preset by a pixel in at least one of an N−1th scanning line of pixels and N+1th scanning line of pixels located in the same column with the non-luminous pixel is obtained.

At block S103: In response to a transition relationship between the first data voltage and the second data voltage existing, a voltage value to be compensated for luminous pixels in the Nth scanning line is obtained based on the transition relationship and the ratio.

Figure 5:
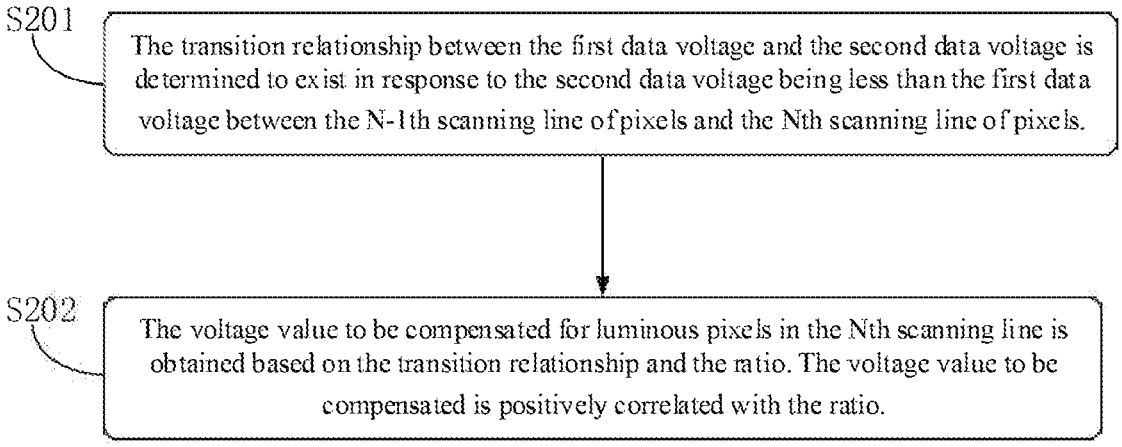
FIG. 5 is a flow chart of the operation S103 in FIG. 2 according to an embodiment of the present disclosure.

Specifically, in some embodiments, as shown in FIG. 3, FIG. 4, and FIG. 5. FIG. 5 is a flow chart of the operation S103 in FIG. 2 according to an embodiment of the present disclosure. The operation S103 may specifically include operations at blocks illustrated in FIG. 5.

At block S201: The transition relationship between the first data voltage and the second data voltage is determined to exist in response to the second data voltage being less than the first data voltage between the N−1th scanning line of pixels and the Nth scanning line of pixels.

Specifically, as shown in FIG. 3, in the direction from the M−1th scanning line to the Mth scanning line, the picture is cut from the white screen to the black screen. The first data voltage of a first data line (data A) corresponding to a non-luminous pixel in the Mth scanning line is at a high level. The second data voltage corresponding to a pixel in the M−1th scanning line located in the same column with the non-luminous pixel is at a low level. That is, there is a transition relationship between the first data voltage and the second data voltage. At the position of the non-luminous pixel in the Mth scanning line, when the picture is cut from the white screen to the black screen, there is distortion in the first data line data A. Due to the coupling effect between the first data line data A and the power line, a power voltage VDD of the power line of the Mth scanning line suddenly changes to a high level.

Since $I_{OLED}=k(VDD-V_{data}-V_{th})^2$, where k is a current amplification factor of the driving thin film transistor, VDD is the power voltage, $V_{data}$ is the data voltage, and $V_{th}$ is a threshold voltage of the driving transistor. For the luminous pixels in the Mth scanning line, the power voltage VDD of the power line suddenly changes to a high level due to the coupling effect, which causes the current flowing through the driving transistor to increase. If compensation is not performed, a bright line occurs at the position of the luminous pixels in the M scanning line.

At block S202: The voltage value to be compensated for luminous pixels in the Nth scanning line is obtained based on the transition relationship and the ratio. The voltage value to be compensated is positively correlated with the ratio.

Figure 6:
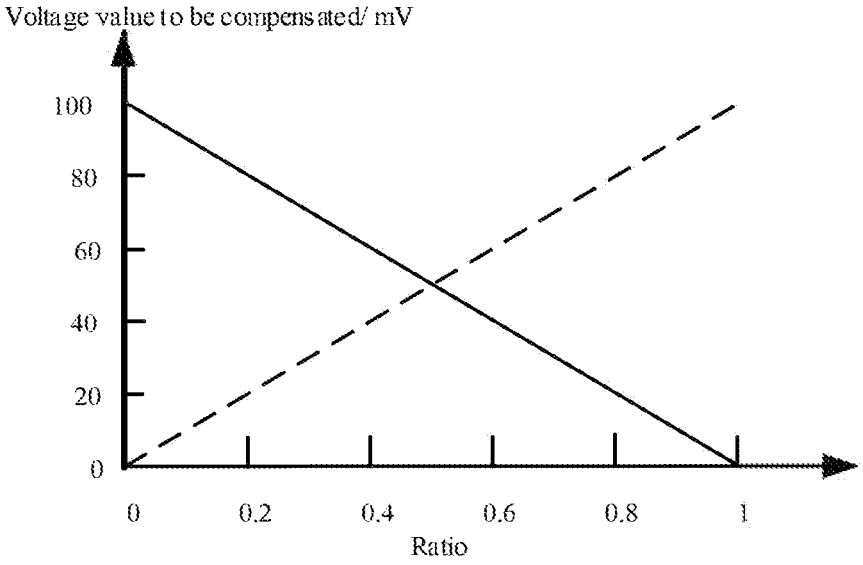
FIG. 6 is a schematic view of the relationship between a voltage value to be compensated and a ratio according to an embodiment of the present disclosure.

Specifically, as shown in FIG. 6, FIG. 6 is a schematic view of the relationship between the voltage value to be compensated and the ratio according to an embodiment of the present disclosure. When the transition relationship is that the white screen cuts into the black screen, the greater the ratio obtained in operation S101, the greater the voltage value to be compensated. In this embodiment, the voltage value to be compensated has a linear positive correlation relationship with the ratio. For example, as shown by the dashed line in FIG. 6, $\Delta V=100\ mV\times K$, where $\Delta V$ is the voltage value to be compensated, and K is the ratio. When the voltage value to be compensated has the linear positive correlation relationship with the ratio, the data processing amount of the driving chip may be reduced, simplifying the data processing. Of course, in other embodiments, the voltage value to be compensated and the ratio may also be a non-linear positive correlation, which is not limited herein.

Figure 7:
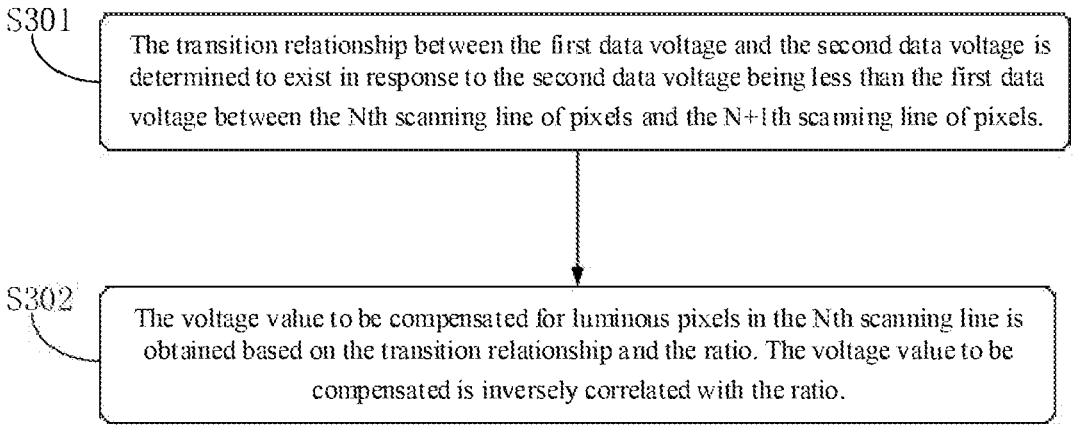
FIG. 7 is a flow chart of the operation S103 in FIG. 2 according to another embodiment of the present disclosure.

In other embodiments, as shown in FIG. 3, FIG. 4, and FIG. 7. FIG. 7 is a flow chart of the operation S103 in FIG. 2 according to another embodiment of the present disclosure. The operation S103 may specifically include operations at blocks illustrated in FIG. 7.

At block S301: The transition relationship between the first data voltage and the second data voltage is determined to exist in response to the second data voltage being less than the first data voltage between the Nth scanning line of pixels and the N+1th scanning line of pixels.

Specifically, as shown in FIG. 3, in the direction from the Pth scanning line to the P+1th scanning line, the picture is cut from the black screen to the white screen. The first data voltage of a first data line (data A) corresponding to a non-luminous pixel in the Pth scanning line is at a high level. The second data voltage corresponding to a pixel in the P+1th scanning line located in the same column with the non-luminous pixel is at a low level. That is, there is a transition relationship between the first data voltage and the second data voltage. At the position of the non-luminous pixel in the Pth scanning line, when the picture is cut from the black screen to the white screen, there is distortion in the first data line data A. Due to the coupling effect between the first data line data A and the power line, a power voltage VDD of the power line of the Pth scanning line suddenly changes to a low level.

Since $I_{OLED}=k(VDD-V_{data}-V_{th})^2$, for the luminous pixels in the Pth scanning line, the power voltage VDD of the power line suddenly changes to a low level due to the coupling effect, which causes the current flowing through the driving transistor to decrease. If compensation is not performed, a dark line occurs at the position of the luminous pixels in the M scanning line.

At block S302: The voltage value to be compensated for luminous pixels in the Nth scanning line is obtained based on the transition relationship and the ratio. The voltage value to be compensated is inversely correlated with the ratio.

Specifically, as shown in FIG. 6, when the transition relationship is that the black screen cuts into the white screen, the greater the ratio obtained in operation S101, the less the voltage value to be compensated. In this embodiment, the voltage value to be compensated has a linear inverse correlation with the ratio. For example, as shown by the solid line in FIG. 6, $\Delta V=-100$ mV×K, where $\Delta V$ is the voltage value to be compensated, and K is the ratio. When the voltage value to be compensated has the linear inverse correlation with the ratio, the data processing amount of the driving chip may be reduced, simplifying the data processing. Of course, in other embodiments, the voltage value to be compensated and the ratio may also be a non-linear inverse correlation, which is not limited herein.

At block S104: The voltage values of other luminous pixels in the Nth scanning line of pixels are compensated to display a picture.

Specifically, when the transition relationship is that the white screen cuts into the black screen, the operation S104 includes: increasing, by the voltage value to be compensated, the predetermined data voltage of the luminous pixel in the Nth scanning line to display the picture. Since $I_{OLED}=k(VDD-V_{data}-V_{th})^2$, the predetermined data voltage is increased to compensate the sudden increase of the power voltage VDD, such that the current may be reduced to weaken the bright line. Moreover, in this embodiment, the implementation is simpler by compensating the data voltage. Of course, in other embodiments, the voltage value may also be compensated at the power voltage VDD, the transistor gate, and the transistor drain, which is not limited herein.

When the transition relationship is that the black screen cuts into the white screen, the operation S104 includes: reducing, by the voltage value to be compensated, the predetermined data voltage of the luminous pixel in the Nth scanning line to display a picture. Since $I_{OLED}=k(VDD-V_{data}-V_{th})^2$, the predetermined data voltage is reduced to compensate the sudden decrease of the power voltage VDD, such that the current may be increased to weaken the dark line. Moreover, in this embodiment, the implementation is simpler by compensating the data voltage. Of course, in other embodiments, the voltage value may also be compensated at the power voltage VDD, the transistor gate, and the transistor drain, which is not limited herein.

In another embodiment, before the operation S102, the compensation method may further include: determining whether the ratio is greater than or equal to a threshold. When the ratio is greater than or equal to the threshold, operation S102 is proceeded to perform. When the ratio is less than the threshold, the picture is displayed normally. In this embodiment, the threshold may be 0-0.2, for example, 0.05, 0.10, etc. When the threshold is 2.0, human eyes can hardly recognize bright and dark lines. Therefore, configuring the threshold between 0 and 0.2 may effectively weaken the bright and dark lines, reduce line crosstalk, and reduce the data processing volume of the driving chip.

In another embodiment, before the operation S101, the compensation method may further include: obtaining the picture being displayed or to be displayed; and determining whether the picture being displayed or to be displayed contains a continuous non-luminous area. When the picture contains the continuous non-luminous area, pixel information about an edge of the non-luminous area in a row direction is obtained and the operation S101 is performed. That is, as shown in FIG. 3, for the whole block of continuous non-luminous area, only the Mth line of pixels and Pth line of pixels at the edge and in the scanning line direction are compensated. Whereas for the pixel lines between the Mth line of pixels and Pth line of pixels are not processed to reduce the amount of data processing.

The above description is for the purpose of illustrating implementations of the present disclosure, but not to limit the scope of the present disclosure. Any equivalent structural or process transformation performed based on the drawings and the specification of the present disclosure, applied directly and indirectly in other related art, should be within the scope of the present disclosure.

What is claimed is:

1. A picture compensation method, comprising:

obtaining a ratio of non-luminous pixels in an Nth scanning line to all pixels in the Nth scanning line;

for each non-luminous pixel in the Nth scanning line, receiving or presetting a first data voltage;

obtaining a second data voltage received or preset by a pixel in at least one of an N−1th scanning line and an N+1th scanning line located in a same column with the non-luminous pixel;

in response to a transition relationship between the first data voltage and the second data voltage existing, obtaining a voltage value to be compensated for luminous pixels in the Nth scanning line based on the transition relationship and the ratio; and displaying a picture after compensating the voltage value of the luminous pixels in the Nth scanning line of pixels.

2. The method according to claim 1, wherein when the transition relationship exists between the first data voltage and the second data voltage, obtaining the voltage value to be compensated for luminous pixels in the Nth scanning line based on the transition relationship and the ratio comprises:

determining the transition relationship between the first data voltage and the second data voltage to exist in response to the second data voltage of the N−1th scanning line being less than the first data voltage of the Nth scanning line; and obtaining the voltage value to be compensated for luminous pixels in the Nth scanning line based on the transition relationship and the ratio, the voltage value to be compensated being positively correlated with the ratio.

3. The method according to claim 2, wherein the voltage value to be compensated has a linear positive correlation relationship with the ratio.

4. The method according to claim 2, wherein the displaying the picture after compensating the voltage value of the luminous pixels in the Nth scanning line of pixels comprises:

increasing, by the voltage value to be compensated, a predetermined data voltage of the luminous pixels in the Nth scanning line to display the picture.

5. The method according to claim 1, wherein when the transition relationship exists between the first data voltage and the second data voltage, obtaining the voltage value to be compensated for luminous pixels in the Nth scanning line based on the transition relationship and the ratio comprises:

determining the transition relationship between the first data voltage and the second data voltage to exist in response to the second data voltage of the N+1th scanning line being less than the first data voltage of the Nth scanning line; and obtaining the voltage value to be compensated for the luminous pixels in the Nth scanning line based on the transition relationship and the ratio, the voltage value to be compensated being inversely correlated with the ratio.

6. The method according to claim 5, wherein the voltage value to be compensated has a linear inverse correlation with the ratio.

7. The method according to claim 5, wherein the displaying a picture after compensating the voltage value of the luminous pixels in the Nth scanning line of pixels comprises:

reducing, by the voltage value to be compensated, a predetermined data voltage of the luminous pixels in the Nth scanning line to display the picture.

8. The method according to claim 1, wherein before the obtaining the second data voltage received or preset by the pixel in at least one of the N−1th scanning line and the N+1th scanning line located in a same column with the non-luminous pixel, the method further comprises:

determining whether the ratio is greater than or equal to a threshold;

performing the obtaining the second data voltage received or preset by the pixel in at least one of the N−1th scanning line and the N+1th scanning line located in a same column with the non-luminous pixel, in response to the ratio being greater than or equal to the threshold;

performing the displaying a picture in response to the ratio being less than the threshold.

9. The method according to claim 8, wherein the threshold is in a range of 0-0.2.

10. The method according to claim 1, wherein before the obtaining the ratio of non-luminous pixels in the Nth scanning line to all pixels in the Nth scanning line, the method further comprises:

obtaining a picture being displayed or to be displayed; and determining whether the picture being displayed or to be displayed contains a continuous non-luminous area;

in response to the picture being displayed or to be displayed containing the continuous non-luminous area, obtaining pixel information about an edge of the non-luminous area in a row direction and performing the obtaining a ratio of non-luminous pixels in an Nth scanning line to all pixels in the Nth scanning line.

11. The method according to claim 10, wherein the obtaining the ratio of non-luminous pixels in the Nth scanning line to all pixels in the Nth scanning line comprises:

obtaining a ratio of a length of continuous non-luminous pixels in the Nth scanning line to a length of a display area.

12. The method according to claim 1, wherein the obtaining the ratio of non-luminous pixels in the Nth scanning line to all pixels in the Nth scanning line comprises:

obtaining a ratio of the number of non-luminous pixels in the Nth scanning line to the total number of the pixels in the Nth scanning line.

13. The method according to claim 1, wherein the obtaining the ratio of non-luminous pixels in the Nth scanning line to all pixels in the Nth scanning line comprises:

obtaining a ratio of the number of driving transistors turned off in the Nth scanning line to the total number of the driving transistors in the Nth scanning line.

14. A display device, comprising:

a pixel driving circuit, comprising a plurality of scanning lines for transmitting scan signals, a plurality of data lines for transmitting data signals, and a plurality of power lines for transmitting voltage signals; and a driving chip, coupled to the plurality of scanning lines and/or the plurality of data lines and/or plurality of power lines for implementing the picture compensation method according to claim 1.

15. The display device according to claim 14, wherein the driving chip comprises a data driving chip connected to the plurality of data lines, the data driving chip executes the picture compensation method according to claim 1.

16. The display device according to claim 14, wherein the driving chip comprises a power driving chip connected to the plurality of power lines, and the power driving chip executes the picture compensation method according to claim 1.

17. The display device according to claim 14, wherein the driving chip comprises a scan driving chip connected to the plurality of scanning lines, and a power driving chip connected to the plurality of power lines.

* * * * *